US007383868B1

(12) United States Patent
Huang

(10) Patent No.: US 7,383,868 B1
(45) Date of Patent: Jun. 10, 2008

(54) TAPE DISPENSER WITH CUTTER SHIELD

(75) Inventor: Harrison Huang, No. 23, Lin T'So Rd., Sheng Kang Hsian, Taichung Hsien (TW)

(73) Assignee: Harrison Huang, Taichung Hsien (TW)

( * ) Notice: Subject to any disclaimer, the term of this patent is extended or adjusted under 35 U.S.C. 154(b) by 0 days.

(21) Appl. No.: 11/646,263

(22) Filed: Dec. 28, 2006

(51) Int. Cl.

| | |
|---|---|
| ***B29C 65/52*** | (2006.01) |
| ***B32B 38/04*** | (2006.01) |
| ***B65H 35/10*** | (2006.01) |
| *B32B 37/14* | (2006.01) |
| *B32B 37/10* | (2006.01) |

(52) U.S. Cl. ..... 156/527; 156/510; 156/576; 156/579; 225/6; 225/19; 225/20; 225/39; 225/91

(58) Field of Classification Search ..... 156/576, 156/577, 574, 523, 579, 527, 475, 510, 538; 225/20, 6, 19, 39, 91
See application file for complete search history.

(56) References Cited

U.S. PATENT DOCUMENTS

| | | | | |
|---|---|---|---|---|
| 2,663,369 | A * | 12/1953 | Erhardt | 225/20 |
| 5,024,362 | A * | 6/1991 | Karlsson | 225/20 |
| 5,393,367 | A * | 2/1995 | Yu Chen | 156/523 |
| 5,641,377 | A * | 6/1997 | Chung et al. | 156/577 |
| 2003/0141337 | A1 * | 7/2003 | Yu Chen | 225/89 |

* cited by examiner

*Primary Examiner*—Philip C Tucker
*Assistant Examiner*—Sonya Mazumdar
(74) *Attorney, Agent, or Firm*—Browdy and Neimark

(57) ABSTRACT

A tape dispenser includes base plate, a handle, a tape reel and a cutting assembly. The cutting assembly includes a base, a cutter with a blade at an end, a shield, a shield base and a wiper plate. The shield is moved between a first position, in which the shield covers the blade of the cutter to protect users from hurt by the cutter, and a second position, in which the shield exposes the blade of the cutter to cut a tape off. The wiper plate has an elastic member with an end urging the shield toward the first position. No independent spring is included to reduce a number of elements and a cost of manufacture.

3 Claims, 5 Drawing Sheets

TAPE DISPENSER WITH CUTTER SHIELD

BACKGROUND OF THE INVENTION

1. Field of the Invention

The present invention relates generally to a tape dispenser, and more particular to a tape with a cutter's shield.

2. Description of the Related Art

A tape dispenser is equipped with a cutter to cut a tape off. In operation of the tape dispenser, the cutter may hurt the user, so that there were some inventions providing devices on the dispenser to protect user from hurt by the cutter. FIG. 1 shows a conventional cutting assembly 60 of a tape dispenser including a movable cutter 62, a spring 64 urging the cutter 62 and a wiper plate 66. Referring to FIG. 2, the wiper plate 66 is moved at one end and the other end of which will push the cutter 62 forward to cut off a tape (not shown). The spring 64 returns the cutter 62 while the wiper plate 66 no longer pushes the cutter 62. FIG. 3 and FIG. 4 show another conventional cutting assembly 70 of a tape dispenser including a fixed cutter 72, a movable shield 74 above the cutter 72 and a spring 76. The shield 74 is urged by the spring 76 to cover the whole cutter 72 in a normal condition. The shield 74 may be moved backward by an external force to expose a blade of the cutter 72 to cut off a tape (not shown). The spring 76 returns the shield 74 while the external force is gone.

These conventional cutting assemblies include an independent spring for return of the cutter or the shield. The spring increases the cost and complexity of manufacture of the dispenser.

SUMMARY OF THE INVENTION

The primary objective of the present invention is to provide a tape dispenser with a cutter shield and without an independent spring for return of the cutter shield.

According to the objective of the present invention, a tape dispenser includes a cutting assembly. The cutting assembly includes a cutter with a blade at an end, a shield and a wiper plate. The shield is moved between a first position, in which the shield covers the blade of the cutter, and a second position, in which the shield exposes the blade of the cutter. The wiper plate has an elastic member with an end urging the shield toward the first position.

DETAILED DESCRIPTION OF THE INVENTION

Figure 5:
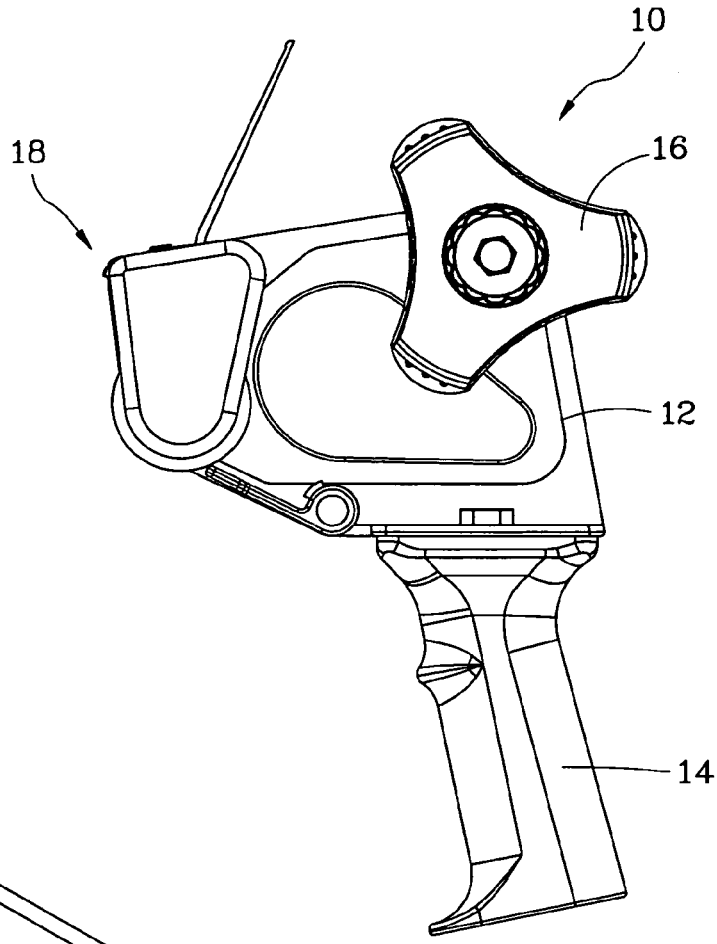
FIG. 5 is a front view of a preferred embodiment of the present invention.

As shown in FIG. 5, a tape dispenser of the preferred embodiment of the present invention includes a base plate 12, a handle 14, a tape reel 16 and a cutting assembly 18. The handle 14 is mounted on a bottom of the base plate 12, the tape reel 16 is provided on a rear side of the base plate 12 to mount a tape roll (not shown) thereon, and the cutting assembly 18 is mounted on a front side of the base plate 12 to cut a tape of the tape roll off.

Figure 7:
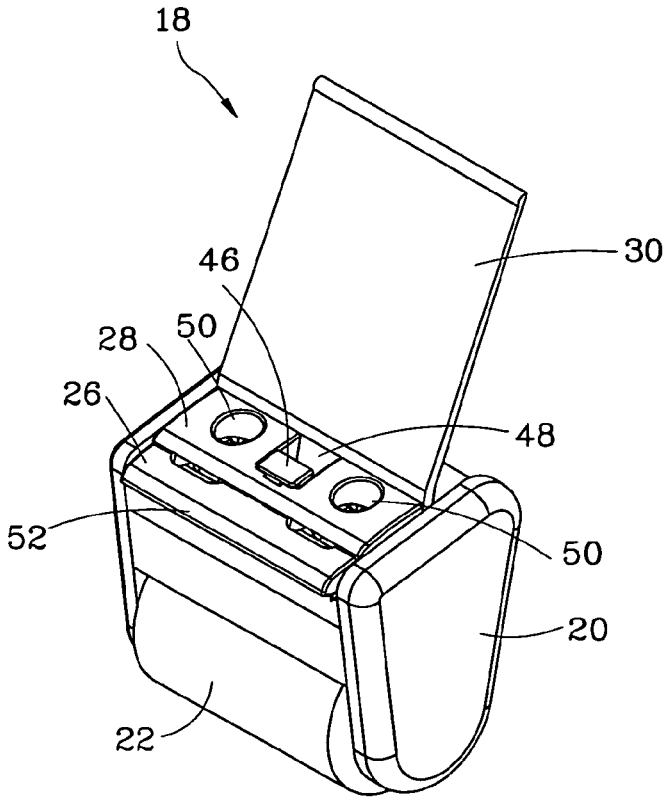
FIG. 7 is a perspective view of the cutting assembly of the preferred embodiment of the present invention.
Figure 6:
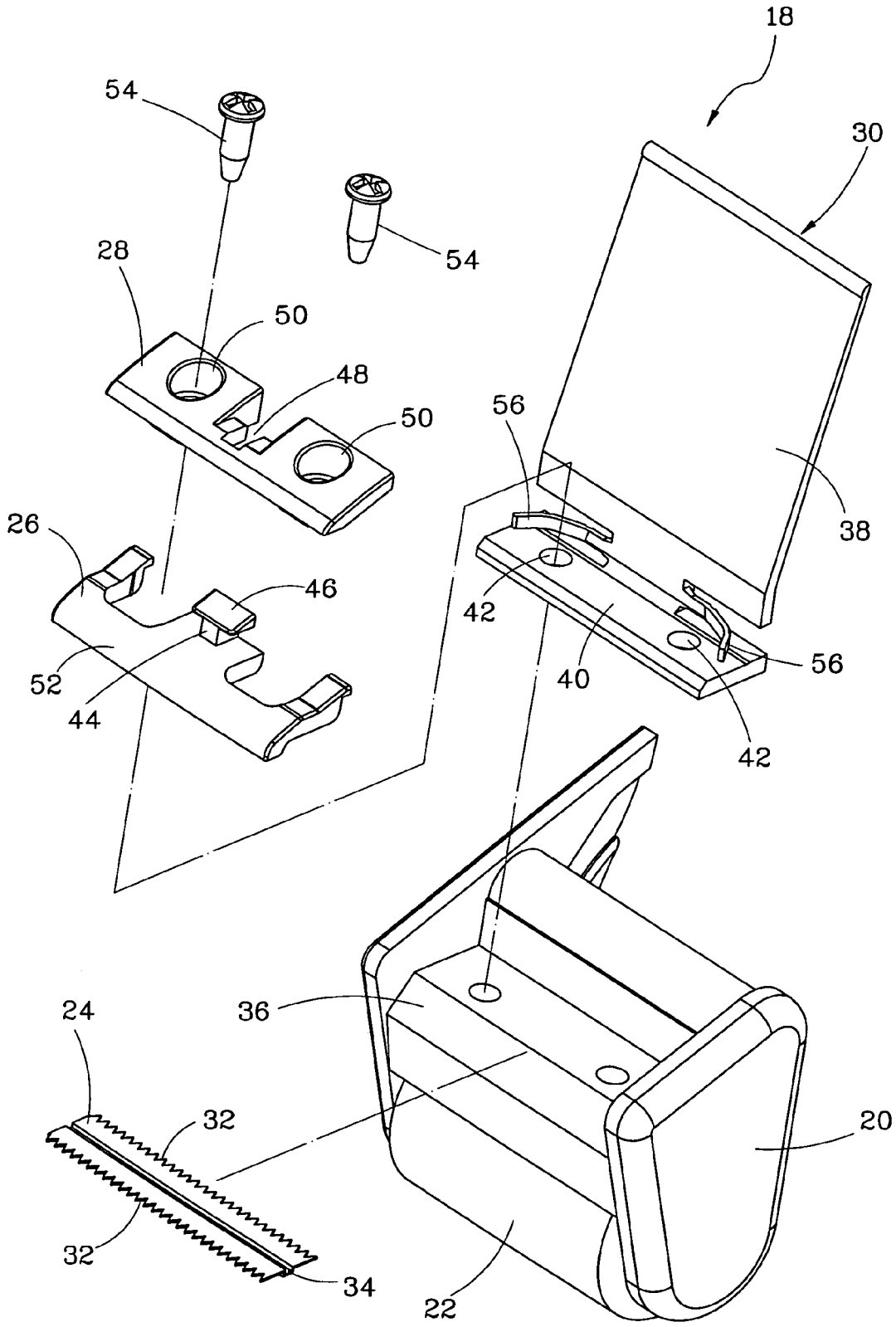
FIG. 6 is an exploded view of the cutting assembly of the preferred embodiment of the present invention.

As shown in FIG. 6 and FIG. 7, the cutting assembly 18 includes a base 20, a roller 22, a cutter 24, a shield 26, a shield base 28 and a wiper plate 30. The base 20 is mounted on the front side of the base plate 12. The roller 22 is pivoted on a bottom of the base 20 for free rotation. The cutter 24, which has blades 32 on opposite ends and a bend portion 34 at a middle, is mounted on a top of the base 20 with the bend portion 34 against a slope portion 36 on a front of the top of the base 20 for positioning. The wiper plate 30 has a main plate 38 and a bottom plate 40. The bottom plate 42, which has two holes 42, rests on a rear part of the cutter 24, behind the bend portion 34. The shield 26 includes a guiding post 44 on a top thereof and a head 46 on a distal end of the guiding post 44. The shield 26 rests its rear part on the bottom plate 40 of the wiper plate 30 and its front part over the cutter 24. The shield base 28 includes a guiding slot 48 and two holes 50 at opposite sides of the guiding slot 48. A width of the guiding slot 48 is greater than that of the guiding post 44 and is less than that of the head 46. The shield base 28 rests on the rear part of the shield 26 with the guiding post 44 in the guiding slot 48, the head 46 above the guiding post 44, and the holes 50 aligned with the holes 42 of the bottom plate 40 of the wiper plate 30. The head 48, which the width thereof is greater than that of the guiding slot 48, may prevent guiding post 44 from escaping from the guiding slot 48. The shield 26 has a curved portion 52 at a front end thereof toward the cutter 24. Two screws 54 is inserted through the holes 42 and 50 of the shield base 28 and the bottom plate 40 of the wiper plate 30 and screwed into the base 20 to secure the above elements.

The wiper plate 30 has two elastic members 56 on the main plate 38 close to the bottom plate 40. Each of the elastic members 56 is a curved strips projected from the main plate 38, in other words, each of the elastic members 56 has an end connected to the main plate 38 and an end suspended. The suspended ends of the elastic members 56 urge a rear end of the shield 26.

Figure 8:
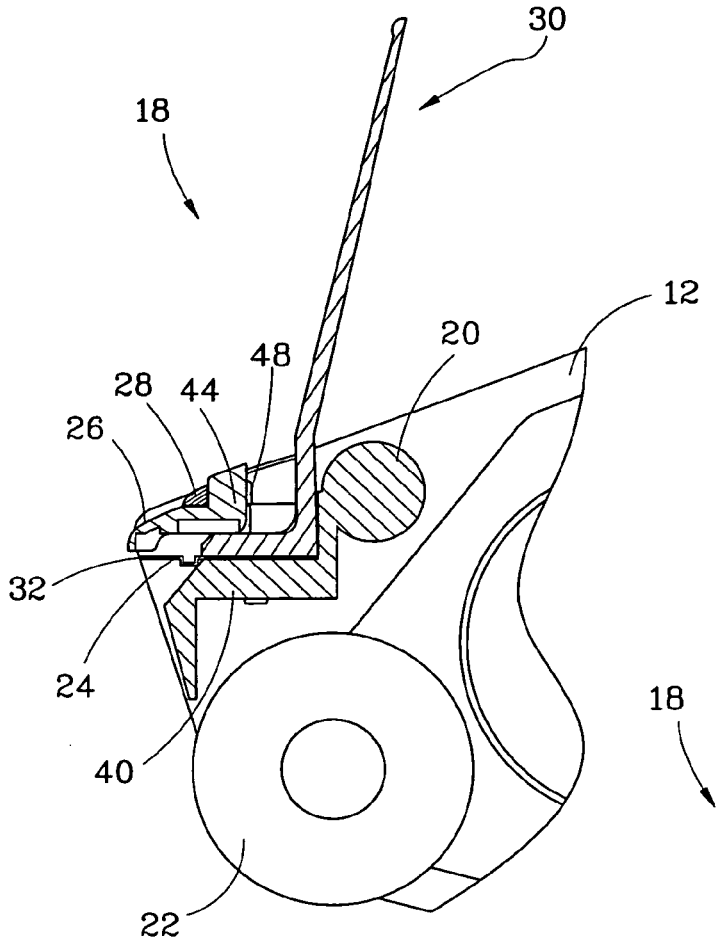
FIG. 8 and FIG. 9 are sectional views of the cutting assembly of the preferred embodiment of the present invention, showing how the shield moves.
Figure 9:
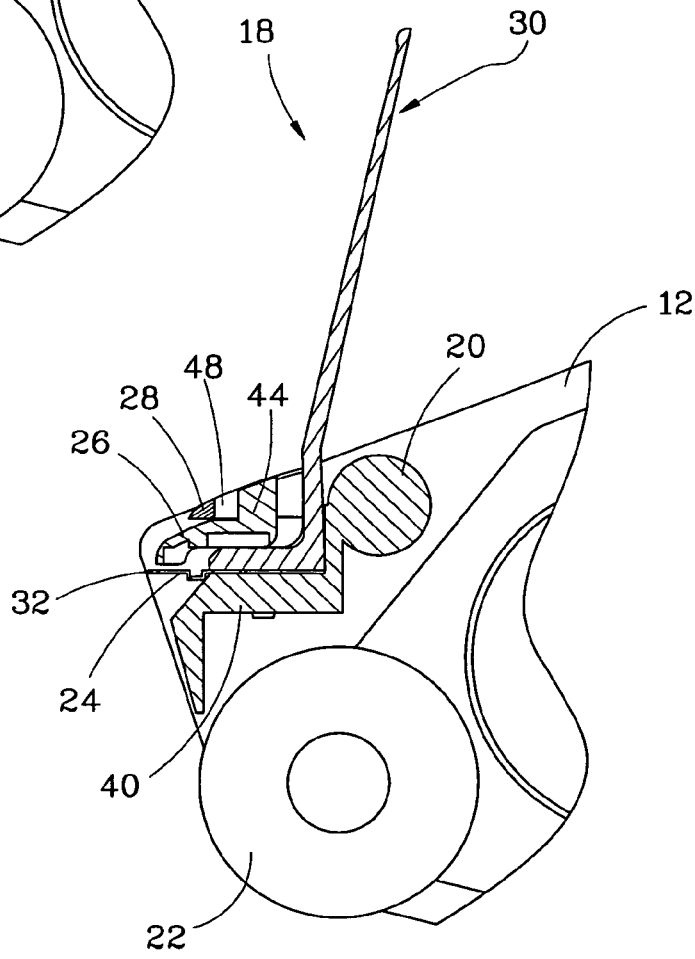
Figure 10:
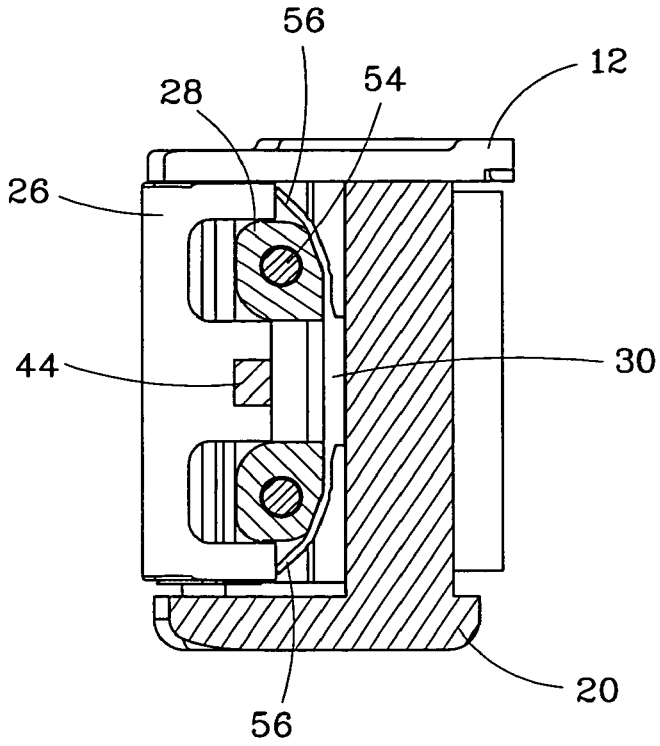
FIG. 10 and FIG. 11 are sectional views of the cutting assembly of the preferred embodiment of the present invention, showing how the shield moves and the action of the elastic members on the wiper plate.
Figure 11:
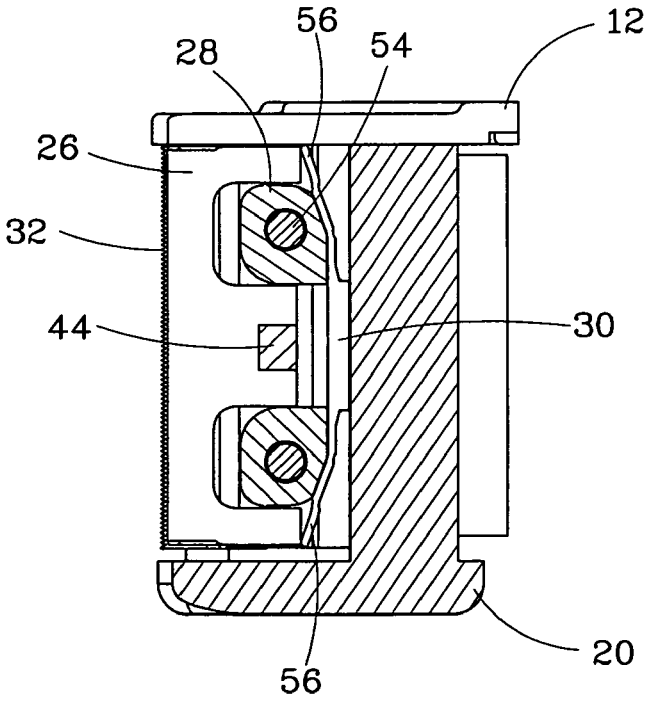

The shield 26 is moved along the guiding slot 48 of the shield base 28 between a first position and a second position. When the shield 26 is moved to the first position, referring to FIG. 8 and FIG. 10, the shield 26 cover the blade 32 at the front end of the cutter 24, and when the shield 26 to the first position, referring to FIG. 9 and FIG. 11, the shield 26 is moved backward and exposes the blade 32 of the cutter 24. While the shield 26 is moved from the first position to the second position, the shield 26 deforms the elastic members 56, so that the elastic members 56 may urge the shield 26 back to the first position. In practice, the elastic members 56 are deformed a little by the shield 26 when the shield 26 is at the first position that the shield 24 is located at the first position (the shield 26 covers the cutter 24) in a normal condition to protect users from hurt by the cutter 24.

The tape dispenser of the present invention provides no independent spring so that the cost of manufacture may be decreased.

Above elements are as same as the conventional tape dispenser, and the characters of the present invention are hereunder.

Figure 3:
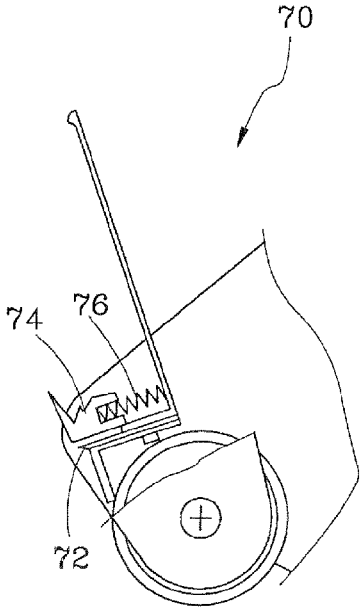
FIG. 3 PRIOR ART
FIG. 3 and FIG. 4 are sketch diagrams of another conventional cutting assembly.

As shown in FIG. 3, the handle 10 has a chamber 24 therein, which is open at the bottom of the handle 10, two openings 26 on a front side and a back side thereof communicated with the chamber 24 and two recesses 28 on the bottom thereof.

A holder 30 includes a base member 32, two lock members 34 and two flexible arms 36. The base member 32 includes a tunnel 38, and the lock members 34 are located at opposite side of the tunnel 38. The lock members 34 have ends connected to base member 32 and the other ends suspended. Each of the lock members 34 has a hook 40 at the suspended end and facing the tunnel 38. The flexible arms 36 are projected from a top of the base member 32 at opposite side of the tunnel 38, each of which has a block 36 facing outwardly. The holder 30 is inserted into the chamber 24 of the handle 10 with the blocks 36 of the flexible arms 36 engaged with the openings 26 of the handle 10, as shown in FIG. 5, to fix the holder 30 in the chamber 24 of the handle 10.

Figure 1:
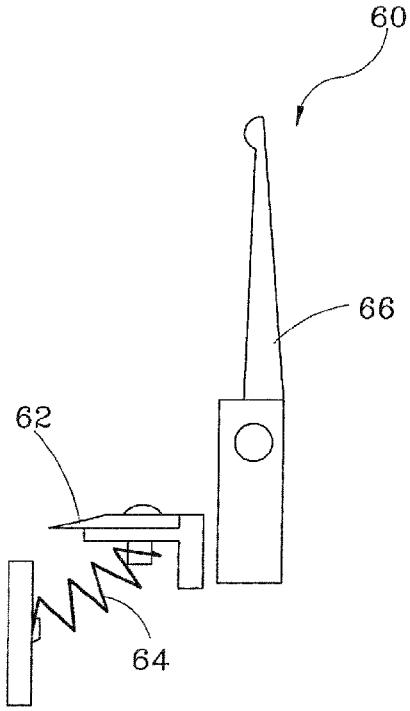
FIG. 1 PRIOR ART
FIG. 1 and FIG. 2 are sketch diagrams of the conventional cutting assembly.
Figure 2:
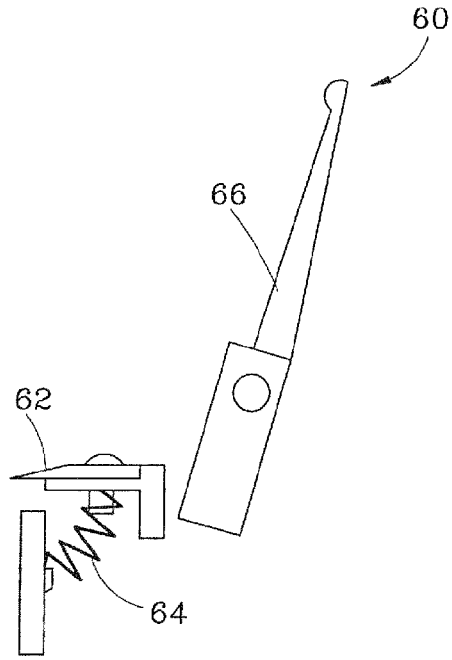
FIG. 2 PRIOR ART
Figure 4:
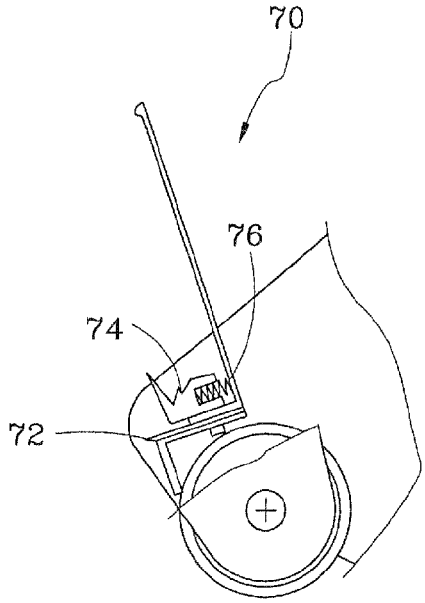
FIG. 4 PRIOR ART

A tool 44, which is a conventional utility knife in the drawings, includes a housing 46 and a blade (not shown) received in the housing 46 to be drawn out. The housing 46 has two couplers 48 at lateral sides, which are blocks or apertures. The utility knife 44 may be inserted into the chamber 24 of the handle 10 and through the tunnel 38 of the holder 30 to have the hooks 40 of the lock members 34 engaged with the couplers 48 of the utility knife 44, such that the utility knife 44 is stored in the chamber 24 of the handle 10, as shown in FIG. 4 and FIG. 7. In such condition, the utility knife 44 has it bottom end exposed by the recesses 28 that user may grip the exposed part of the utility knife 44. When user grips the utility knife 44 and exerts for trying to draw the utility knife 44 out of the handle 10, the suspended ends of the lock members will be moved outwardly to disengage the hooks 40 with the couplers 48, such that the utility knife 44 may be drawn out of the handle 10 for operation alone and freely, as shown in FIG. 2)

The main scope of the present invention is that we don't change the structure of the conventional tape dispenser, and we just use the useless space in the handle to store a tool that increases the practicability of the tape dispenser much.

The holder is the device we provide to hold the tool in the chamber of the handle. In practice, it may be made on the handle directly rather than it is an independent element like the embodiment of the present invention. The present invention provides the blocks and the openings on the handle to fix the holder in the handle that makes the holder could be detachable. In practice, the holder may be just simply fixed in the handle by glue or other fastening means. The embodiment of the present invention only shows the tool as utility knife. In fact, the tool, except utility knife, may be screwdriver, wrench or other toll that may be help in the tape dispenser job. Of course, the holder should be redesigned to fit the vary tool to be stored in the handle.

What is claimed is:

1. A tape dispenser comprising a cutting assembly including a cutter with a blade at an end, a shield and a wiper plate, wherein the shield is moved between a first position, in which the shield covers the blade of the cutter, and a second position, in which the shield exposes the blade of the cutter, and the wiper plate has an elastic member with an end connected to the wiper plate and a distal end suspended, wherein the elastic member urges the shield toward the first position;

wherein the wiper plate has a main plate and a bottom plate, and the elastic is projected from the main plate and urges the shield;

wherein the cutting assembly further includes a shield base with a guiding slot to receive a guiding post on a top of the shield therein, and the shield rests on the bottom plate of the wiper plate and the shield base rests on the shield.

2. The tape dispenser as defined in claim 1, wherein the guiding post has a head with a width greater than that of the guiding slot of the shield base.

3. The tape dispenser as defined in claim 1, wherein the elastic member is a curved strip projected from the wiper plate.

* * * * *